US006237563B1

(12) United States Patent
Froehlich et al.

(10) Patent No.: US 6,237,563 B1
(45) Date of Patent: May 29, 2001

(54) METHOD FOR CONTROLLING AN INTERNAL COMBUSTION ENGINE

(75) Inventors: Johann Froehlich, Landshut; Hong Zhang; Stefan Treinies, both of Regensburg, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/494,781

(22) Filed: Jan. 31, 2000

Related U.S. Application Data

(63) Continuation of application No. PCT/DE98/02019, filed on Jul. 17, 1998.

(30) Foreign Application Priority Data

Jul. 31, 1997 (DE) ..... 197 33 106

(51) Int. Cl.[7] ..... F02D 41/00
(52) U.S. Cl. ..... 123/350; 123/436; 123/399
(58) Field of Search ..... 123/350, 352, 123/399, 406.24, 436; 73/118.1, 118.2

(56) References Cited

U.S. PATENT DOCUMENTS

| | | | | |
|---|---|---|---|---|
| 4,300,503 | * | 11/1981 | Deleris et al. | 123/425 |
| 4,586,473 | * | 5/1986 | Nguyen | 123/419 |
| 5,383,434 | * | 1/1995 | Kugler et al. | 123/419 |
| 5,421,302 | | 6/1995 | Livshits et al. | 123/339.23 |
| 5,577,474 | * | 11/1996 | Livshiz et al. | 123/339.1 |

FOREIGN PATENT DOCUMENTS

| | | | |
|---|---|---|---|
| 4232974A1 | | 4/1994 | (DE) . |
| 4315885C1 | | 11/1994 | (DE) . |
| 196 48 159A1 | | 6/1997 | (DE) . |
| 0413031A1 | | 2/1991 | (EP) . |
| 2688546 | | 9/1993 | (FR) . |
| 2271198A | * | 4/1994 | (GB) . |

OTHER PUBLICATIONS

Japanese Patent Abstract No. 60001375 (Toshiharu), dated Jan. 7, 1985.

* cited by examiner

*Primary Examiner*—Henry C. Yuen
*Assistant Examiner*—Mahmoud M Gimie
(74) *Attorney, Agent, or Firm*—Herbert L. Lerner; Laurence A. Greenberg; Werner H. Stemer

(57) ABSTRACT

A method for controlling an internal combustion engine includes the determination of a measured value of an actual torque. An estimated value of the actual torque is determined as a function of operating variables of the internal combustion engine. A correction value is calculated as a function of the estimated value and the measured value of the actual torque. A setpoint value of the torque that is to be set by the air mass flow rate is calculated as a function of a pedal position, which is determined by a pedal position sensor, and of at least one further operating variable, and correction as a function of the correction value. An actuator signal for an actuator element of the internal combustion engine is determined as a function of the corrected setpoint value of the torque.

11 Claims, 3 Drawing Sheets

METHOD FOR CONTROLLING AN INTERNAL COMBUSTION ENGINE

CROSS-REFERENCE TO RELATED APPLICATION

This is a continuation of copending International Application PCT/DE98/02019, filed Jul. 17, 1998, which designated the United States.

BACKGROUND OF THE INVENTION

Field of the Invention

The invention lies in the field of internal combustion engines. The invention relates to a method for controlling an internal combustion engine. In a method according to German Published, Non-Prosecuted Patent Application 42 32 974 A1, an estimated value of an ignition-angle-standardized actual torque is determined. A setpoint value of a torque that is to be set by the air mass flow rate is determined in a device for specifying torque values. The setpoint value of the torque is corrected as a function of a deviation of the setpoint value from the standardized estimated value of the torque. The corrected setpoint value of the torque is assigned to a setpoint value of the air mass flow rate as a function of the rotational speed, the value then being set by a corresponding degree of opening of a throttle valve. An ignition angle is adjusted as a function of the deviation of the setpoint value from the standardized estimated value of the torque.

If the determination of the torque setpoint value is additionally performed taking into account various torque requests, for example (1) of a traction controller, (2) of a torque derivative action for heating a catalytic converter, or (3) a torque request of an engine drag torque controller, deviations between the standardized estimated value of the torque and the setpoint value of the torque occur even during steady-state operation of the internal combustion engine. The air mass flow rate, assigned to the corrected setpoint value of the torque, in a cylinder of the internal combustion engine cannot be set until after a long delay time. Accordingly, the correction of the torque as a function of the setpoint value and of the estimated value of the torque gives rise to severe oscillations in the air mass flow rate, thus giving rise to a need for adjusting the ignition angle. Such adjustment results in a reduction of driving comfort and an increase in emissions.

A method for setting the torque on an internal combustion engine is disclosed in German Patent No. 43 15 885 C1. A regulator having the air mass flow rate as the controlled variable is provided and generates an actuation signal for a throttle valve. The system deviation of the regulator is formed from an average air mass flow rate, which is calculated using an inversely clocked load filter as a function of a predefined load setpoint value, and a measured air mass flow rate.

SUMMARY OF THE INVENTION

It is accordingly an object of the invention to provide a method for controlling an internal combustion engine that overcomes the hereinafore-mentioned disadvantages of the heretofore-known devices and methods of this general type, that is precise and, at the same time, has good step-value characteristics with respect to torque step-values over the entire operating time of the internal combustion engine.

With the foregoing and other objects in view, there is provided, in accordance with the invention, a method for controlling an internal combustion engine, including the steps of determining a measured value of an actual torque that is being output to an output shaft of an internal combustion engine, determining an estimated value of the actual torque as a function of operating variables of the internal combustion engine, adapting a predefined correction value as a function of the estimated value of the actual torque and of the measured value of the actual torque, setting a setpoint value of the torque by an air mass flow rate as a function of a pedal position that is determined by a pedal position sensor and is calculated by at least one further operating variable, correcting the setpoint value of the torque as a function of the correction value, and determining an actuator signal for an actuator element of the internal combustion engine as a function of the corrected setpoint value of the torque.

In accordance with another mode of the invention, there is provided the step of correcting the estimated value of the actual torque as a function of the correction value.

In accordance with a further mode of the invention, there is provided the step of actuating an emergency operating mode of the internal combustion engine if a deviation of the estimated value of the actual torque from the measured value of the actual torque is greater than a predefined threshold value.

In accordance with an added mode of the invention, there is provided the step of actuating an emergency operating mode of the internal combustion engine if a time integral over a deviation of the estimated value of the actual torque from the measured value of the actual torque is greater than a predefined threshold value.

In accordance with an additional mode of the invention, the actuating step of the emergency operating mode is performed by limiting a rotational speed of a crankshaft.

In accordance with yet another mode of the invention, there is provided the step of calculating the correction value as a function of a rotational speed and of the air mass flow rate into a cylinder of the internal combustion engine by filtering the deviation of the estimated value of the actual torque from the measured value of the actual torque.

In accordance with yet a further mode of the invention, there is provided the step of determining the estimated value of the actual torque as a function of an ignition-angle efficiency value, an air/fuel ratio efficiency value and a reference value of the torque, the reference value of the torque depending on the air mass flow rate into the cylinder and on a rotational speed.

In accordance with yet an added mode of the invention, there is provided the step of additionally determining the estimated value of the actual torque as a function of a cylinder shut-off efficiency value.

In one advantageous refinement of the invention, an observer is provided that determines an air mass flow rate into a cylinder of the internal combustion engine as a function of a measured air mass flow rate. The observer includes a dynamic filling model of the intake tract of the internal combustion engine.

In accordance with yet an additional mode of the invention, there is provided the step of determining the air mass flow rate by an observer as a function of a measured air mass flow rate.

In accordance with a concomitant mode of the invention, the determining an actuator signal step is performed by determining an actuator signal for a throttle valve of the internal combustion engine.

Other features that are considered as characteristic for the invention are set forth in the appended claims.

Although the invention is illustrated and described herein as embodied in a method for controlling an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
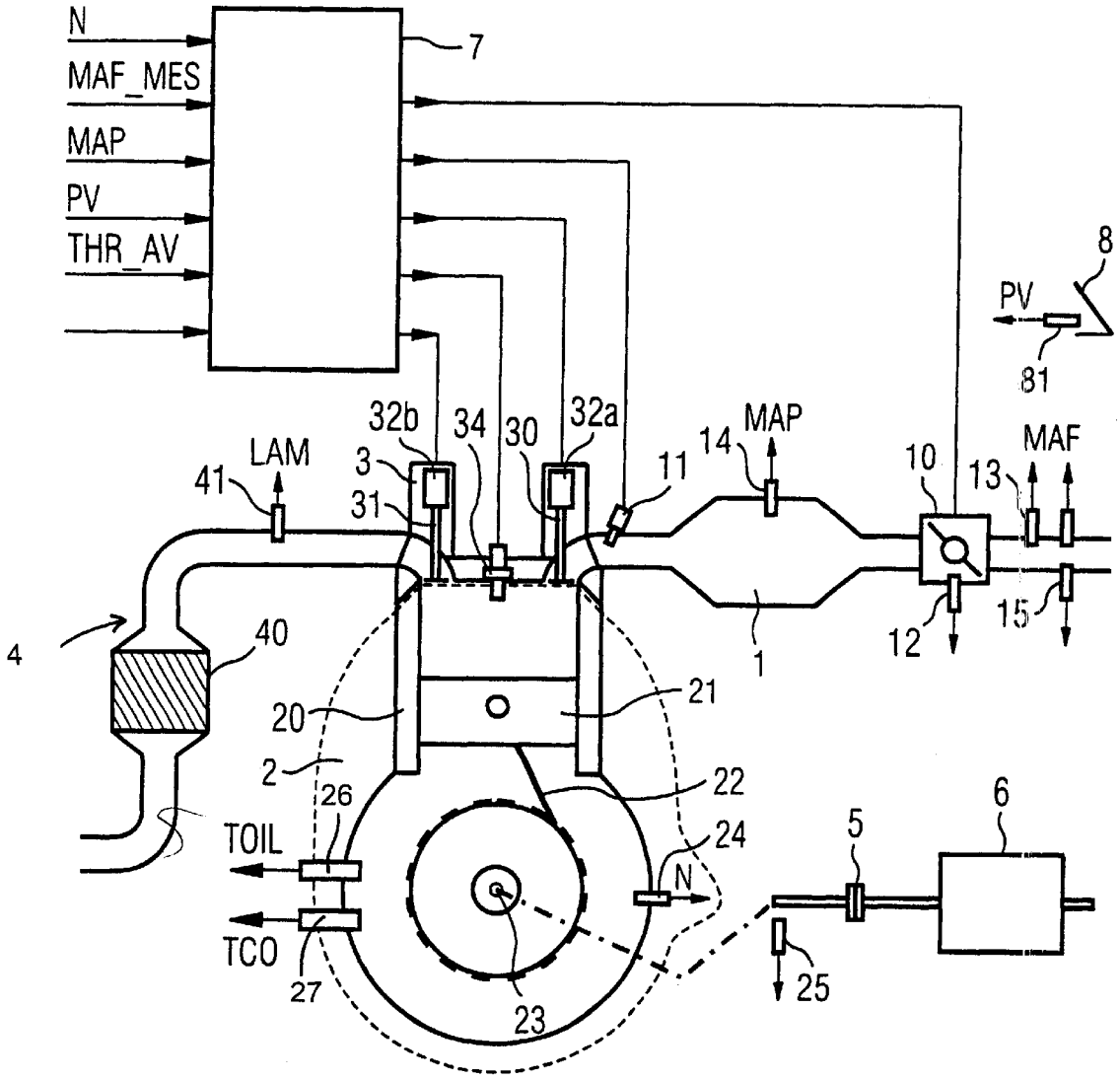
FIG. 1 is a diagrammatic representation of an internal combustion engine with a control device.

In all the figures of the drawing, sub-features and integral parts that correspond to one another bear the same reference symbol in each case.

Referring now to the figures of the drawings in detail and first, particularly to FIG. 1 thereof, there is shown an internal combustion engine having an intake tract 1 with a throttle valve 10 and an engine block 2, which has a cylinder 20 and a crankshaft 23. A piston 21 and a connecting rod 22 are assigned to the cylinder 20. The connecting rod 22 is connected to the piston 21 and the crankshaft 23.

A cylinder head 3 includes a valve drive having at least one inlet valve 30, one outlet valve 31 and in each case one valve drive 32*a* assigned to the inlet valve 30, and one valve drive 32*b* assigned to the outlet valve 31. The valve drives 32*a*, 32*b* each include a non-illustrated camshaft with a transmission device that transmits the cam stroke to the inlet valve 30 and the outlet valve 31, respectively. Devices for adjusting the valve stroke times and the profile of the valve stroke may also be provided. Alternatively, an electromagnetic actuator, which controls the valve stroke profile of the inlet and outlet valves 30, 31, may also be provided.

In the intake tract 1 there is an injection valve 11 that is configured such that the fuel is metered into the intake tract 1. However, alternatively, the injection valve 11 can also be provided in the cylinder head 3, and disposed there such that the fuel is metered directly into the interior of the cylinder 20.

A spark-plug 34 is provided in a recess in the cylinder head 3. The internal combustion engine is represented in FIG. 1 with one cylinder. However, the engine can also include a plurality of cylinders.

The internal combustion engine has an exhaust tract 4 with a catalytic converter 40. The crankshaft 23 can be coupled to a transmission 6 through a clutch 5. If the transmission 6 is embodied as an automatic transmission, the clutch 5 is embodied as a converter lock-out clutch, preferably with a hydrodynamic converter.

The internal combustion engine has a control device 7 and sensors that sense various measurement variables and determine the measured value of the respectively measurement variable that are assigned thereto. The control device 7 determines, as a function of at least one operating variable, one or more actuation signals that each controls an actuator unit.

The sensors include a pedal position sensor 81 that senses a pedal position PV of the accelerator 8, a throttle-valve position sensor 12 that senses a degree of opening of the throttle valve, an air mass flow rate meter 13 that senses an air mass flow rate, and/or an intake-manifold pressure sensor 14 that senses an intake manifold pressure in the intake tract 1, a first temperature sensor 15 that senses an intake-air temperature, a rotational speed sensor 24 that senses a rotational speed N of the crank shaft 23, a torque sensor 25 that senses the actual torque output by the crankshaft 23, and a second and third temperature sensor 26, 27 that respectively sense an oil temperature TOIL and/or a coolant temperature TCO. The control device 7 may have any desired subset of the aforesaid sensors or additional sensors may also be assigned to it.

Operating variables include measurement variables and variables that are derived from the measurement variables and that are determined, using a characteristic diagram relationship, by an observer that calculates estimated values of the operating variables.

The actuator units each include an actuator drive and an actuator element. The actuator drive is an electromotive drive, an electromagnetic drive, a mechanical drive, or some other drive known to a person skilled in the art. The actuator elements are embodied as a throttle valve 10, an injection valve 11, a spark-plug 34, or as an adjustment device for adjusting the valve stroke of the inlet and/or outlet valves 30, 31. Below, reference is made to the actuator units by way of the respectively assigned actuator element.

The control device is preferably embodied as an electronic engine controller. However, it may also include a plurality of control units that are electrically connected to one another, for example by a bus system.

The function of the part of the control device 7 that is relevant to the invention is described below with reference to the block circuit diagrams of FIGS. 2 and 3. In a block B1 (FIG. 2), an estimated value of the air mass flow rate MAF_CYL into the cylinder 20 is calculated using a filling model of the intake tract 1 as a function of the measured value of the air mass flow rate MAF_MES and further operating variables. Such a model is disclosed in International PCT publication WO 96/32579, the contents of which are hereby incorporated by reference.

A characteristic diagram KFl is provided, from which a first component of a loss torque TQ_LOSS is determined as a function of the rotational speed N of the estimated value of the air mass flow rate MAF_CYL into the cylinder 20, and preferably of an estimated value of an exhaust emission mass flow rate into the cylinder 20. The first component of the loss torque TQ_LOSS includes pumping losses in the internal combustion engine and losses that occur as a result of friction at predefined reference values of the coolant temperature TCO and of the oil temperature TOIL. A second component of the loss torque is determined from a characteristic diagram KF2 as a function of the oil temperature TOIL and/or of the coolant temperature TCO. At a logic operation point V1, the components of the loss torque are then added and multiplied by a correction value COR2 or added to the correction value COR2.

The correction value COR2 is determined in a block B9, which is described below.

In a block B2, a minimum and a maximum torque that can be made available are determined as a function of the loss torque TQ_LOSS and the rotational speed N. The pedal position PV and the rotational speed N determine what proportion of the available torque is requested by the driver.

A desired torque TQI_REQ is then determined from the requested portion of the torque and the available torque. Preferably, there is also a provision for filtering the desired TQI_REQ in order to ensure that no load jumps can occur, affects that can lead to undesired bucking of the vehicle.

A setpoint value of the torque TQI_SP_MAF that is to be set by the air mass flow rate is determined in a block B3. In addition to the desired torque TQI_REQ, further torque requests are also taken into account in block B3. The torque requests include, for example, a torque that is requested by an idling controller TQI_IS, a torque that is requested in order to heat up a catalytic converter TQI_CH, a torque request of a traction controller TQI_ASC, a torque request of a rotational speed limiter TQI_N_MAX, or the torque request of an engine drag torque controller TQI_MSR. Thus, the setpoint value of the torque TQI_SP_MAF can be larger or even smaller than the desired torque TQI_REQ.

The setpoint value of the torque TQI_SP_MAF is corrected in a block B4 using a correction value COR1 that is determined in the block B9. The correction in block B4 takes place either by multiplying the setpoint value TQI_SP_MAF of the torque by the correction value COR1 and/or by adding the correction value COR1.

A setpoint value MAF_SP of the air mass flow rate is assigned by a characteristic diagram KF3 to the corrected setpoint value of the torque TQI_SP_MAF_COR as a function of the rotational speed N. The values of the characteristic diagram KF3 are determined on an engine test bench with a fuel/air ratio LAM_REF and a reference ignition angle IGA_REF at which the torque is at a maximum at the respective operating point, or by a simulation calculation.

A setpoint value of the degree of opening of the throttle valve THR_SP is determined in a block B5 as a function of the setpoint value MAF_SP of the air mass flow rate. An actuation signal for actuating the throttle valve, preferably by a position controller of the throttle valve, is determined in a block B6.

In a block B12, a setpoint value of the injection time TI_SP and a setpoint value of the ignition angle IGA_SP are derived from the desired torque TQI_REQ, an actual torque TQI_AV, and, preferably, the estimated value TQI_MAF_CYL of the air mass flow rate into the cylinder 20. In addition, in the block B12 further torque requests, which have to be implemented very quickly as an actual torque (i.e., the torque request of the traction controller), are taken into account. In the process, a very rapid change in the actual torque may occur, in particular, if a corresponding filling derivative action has been set in the cylinder 20 by the setpoint value of the torque TQI_SP_MAF that is to be set by the air mass flow rate, because a change in the injection time or in the ignition angle directly affects the torque.

The estimated value TQ_AV of the actual torque is determined in a block B8. A characteristic diagram KF4 (FIG. 3) is provided in which reference values of the torque TQI_REF are stored as a function of the estimated value MAF_CYL and of the rotational speed N. The characteristic diagram KF4 is determined, like the characteristic diagram KF3, on an engine test bench with the respective reference ignition angle IGA_REF and the respective reference fuel/air ratio LAM_REF, or is calculated by a simulation calculation. Accordingly, the reference torque TQI_REF is in each case the maximum torque that can be theoretically realized at the respective rotational speed and with the respective air mass flow rate into the cylinder.

The reference value of the torque TQI_REF is corrected using the correction value COR1 in a block B80. The correction is carried out in each case with the mathematical operation that is respectively inverse in relation to that in block B4. If, for example, the setpoint value of the torque TQI_SP_MAF is multiplied by the correction value COR1 in block 4, the reference value TQI_REF of the torque is divided by the correction value COR1 in the block B80. The output variable of the block B80 is a corrected reference value of the torque TQI_REF_COR.

The reference ignition angle IGA_REF is determined in a block B81 as a function of the rotation speed N and the estimated value of the air mass flow rate MAF_CYL into the cylinder 20, and, preferably, also as a function of the coolant temperature TCO.

The difference between the setpoint value of the ignition angle IGA_SP and the reference value of the ignition angle IGA_REF is calculated in a logic operation point V2. An ignition-angle efficiency value EFF_IGA is then determined in block B82 as a function of the difference formed in the logic operation point V2.

A reference value of the fuel/air ratio LAM_REF is determined in a block B83 as a function of the rotational speed and the estimated value MAF_CYL. The reference value LAM_REF is in each case the optimum value of the fuel/air ratio in terms of maximizing the actual torque for the current operating point. The difference between the setpoint value of the fuel/air ratio LAM_SP and the reference value of the fuel/air ratio LAM_REF is calculated in the logic operation point V3. A fuel/air ratio efficiency value EFF_LAM is then calculated in a block B84 as a function of the difference determined in the logic operation point V3.

A cylinder shut-off efficiency value EFF_SCC is determined in a block B85. The cylinder shut-off efficiency value is preferably calculated from the number of cylinders fired per work cycle of the internal combustion engine related to the total number of cylinders.

The estimated value TQI_AV of the indexed, actual torque is determined in a block B86 by multiplying the corrected reference value of the torque TQI_REF_COR by the ignitionangle efficiency value EFF_IGA, by the fuel/air ratio efficiency value EFF_LAM, and by the cylinder shut-off efficiency value EFF_SCC, the estimated value of the actual torque TQ_AV at the clutch 5 being calculated from the estimated value TQI_AV by adding the loss torque TQ_LOSS.

Figure 2:
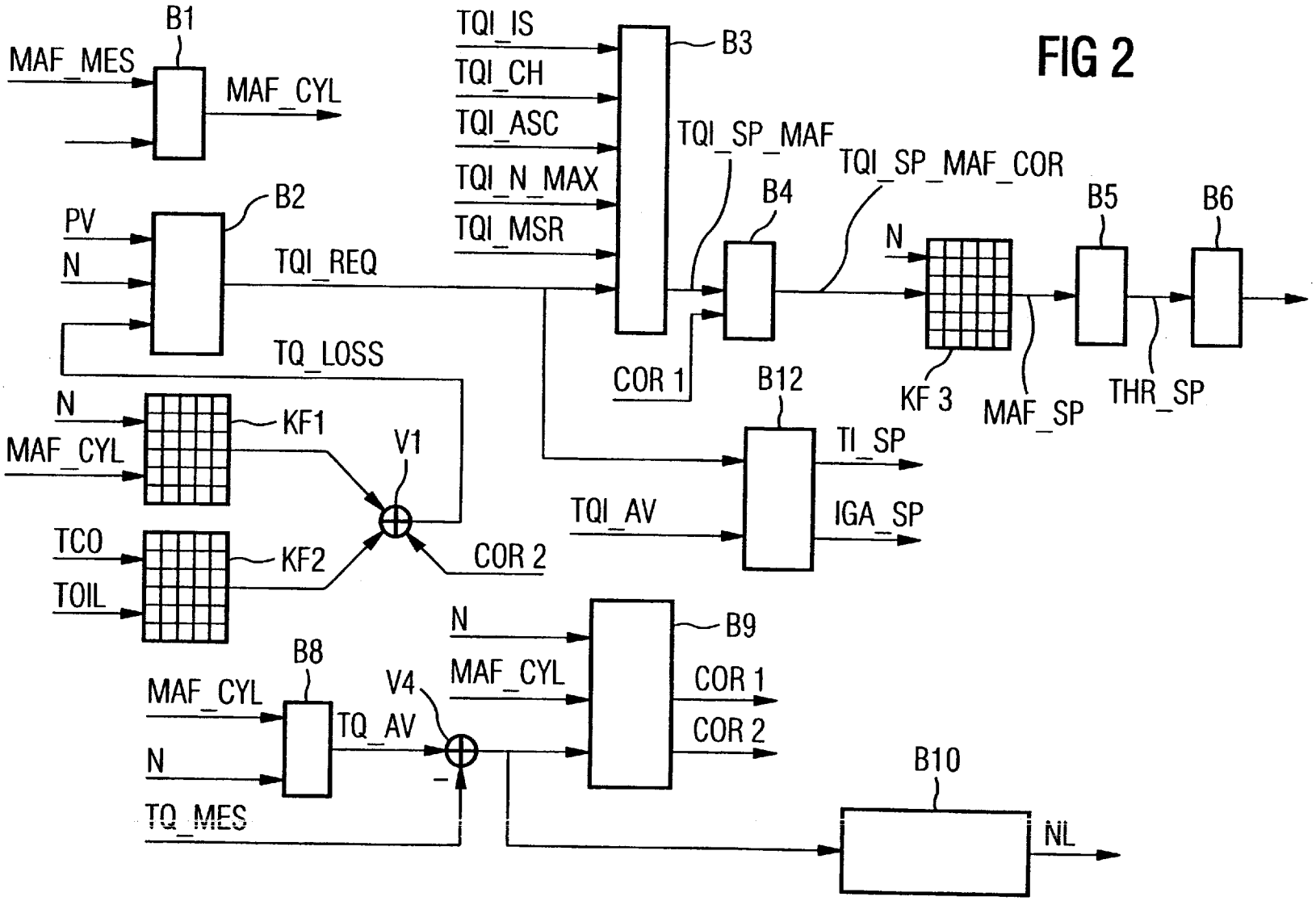
FIG. 2 is a block circuit diagram of the control device.
Figure 3:
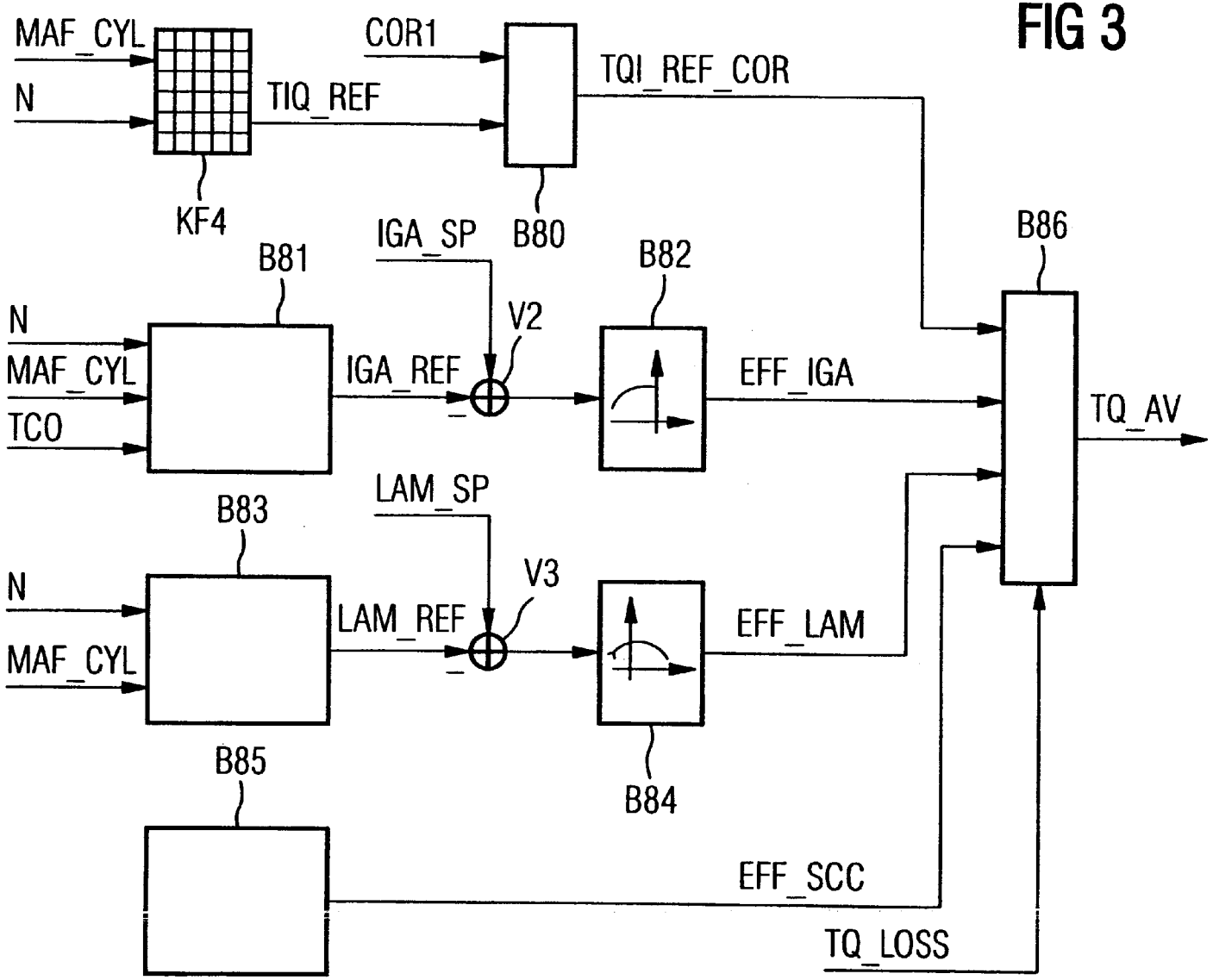
FIG. 3 is a detailed block circuit diagram of block B2 in FIG. 2, in which an estimated value of an actual torque is determined.

The difference between the estimated value of the actual torque TQ_AV and the measured value of the actual torque TQ_MES, determined by the torque sensor 25, is calculated in the logic operation point V4 (FIG. 2). The correction value COR1 or COR2 is then calculated in a block B9 as a function of this difference. Preferably, a plurality of values of the correction value COR1, COR2 is provided as a function of the air mass flow rate MAF_CYL and the rotation speed N. The correction value that is respectively provided for the current rotational speed N and the current estimated value of the air mass flow rate MAF_CYL is adapted as a function of the difference between the estimated value of the actual torque TQ_AV and the measured value of the actual torque TQ_MES. Forming sliding average values preferably carries out the adaptation. The second correction value COR2 is adapted in the overrun operating state because, in this operating state, the reference value of the torque TQI_REF is equal to zero. In the other operating states of the internal combustion engine, the correction value COR1 is adapted in the block B9. In addition, the assigned value of the correction value COR1, COR2 is determined in the block B9 as a function of the current rotational speed N and the current estimated value of the air mass flow rate MAF_CYL, and the assigned value of the correction value COR1, COR2 is then fed to the logic operation point V1, the block B4, and the block B80. A particularly precise and, at the same time, easy means of adaptation is obtained if: an additive correction value is determined when the air mass flow rate is low and the rotational speed is low; a multiplicative correction value is determined when the rotational speeds are at medium to high values and the air mass flow rate is low; a multiplicative correction value is determined when the rotation speeds are low and the air mass flow rate is at medium to high values; and a multiplicative correction value is determined when the rotational speeds are at medium to high values and the air mass flow rate is at medium to high values.

Whether or not the difference between the estimated value of the actual torque TQ_AV and the measured value of the actual torque TQ_MES is greater than a predefined threshold value SW is tested in a block B10. If the measured value of the actual torque TQ_MES is greater than a predefined threshold value SW, it is assumed that there is an error in the calculation of the torque, and a first emergency operating mode is actuated, which mode is advantageously a limitation of the rotational speed N. Alternatively, whether or not the time integral over the difference between the estimated value TQ_AV and the measured value TQ_MES of the actual torque is greater than the predefined threshold value SW is tested in the block B10.

A significant advantage of the method is that inaccuracies in the characteristic diagrams KF3 and KF4 that are due to fabrication tolerances and aging of the internal combustion engine are derived from the difference between the estimated value of the actual torque TQ_AV and the measured value of the actual torque TQ_MES.

We claim:

1. A method for controlling an internal combustion engine, which comprises the step of:

determining a measured value of an actual torque that is being output to an output shaft of an internal combustion engine;

determining an estimated value of the actual torque as a function of operating variables of the internal combustion engine;

adapting a predefined correction value as a function of the estimated value of the actual torque and of the measured value of the actual torque;

setting a setpoint value of the torque by an air mass flow rate as a function of a pedal position that is determined by a pedal position sensor and is calculated by at least one further operating variable;

correcting the setpoint value of the torque as a function of the correction value; and determining an actuator signal for an actuator element of the internal combustion engine as a function of the corrected setpoint value of the torque.

2. The method according to claim 1, which comprises correcting the estimated value of the actual torque as a function of the correction value.

3. The method according to claim 1, which comprises actuating an emergency operating mode of the internal combustion engine if a deviation of the estimated value of the actual torque from the measured value of the actual torque is greater than a predefined threshold value.

4. The method according to claim 1, which comprises actuating an emergency operating mode of the internal combustion engine if a time integral over a deviation of the estimated value of the actual torque from the measured value of the actual torque is greater than a predefined threshold value.

5. The method according to claim 3, wherein the actuating step of the emergency operating mode is performed by limiting a rotational speed of a crankshaft.

6. The method according to claim 4, wherein the actuating step of the emergency operating mode is performed by limiting a rotational speed of a crankshaft.

7. The method according to claim 1, which comprises calculating the correction value as a function of a rotational speed and of the air mass flow rate into a cylinder of the internal combustion engine by filtering the deviation of the estimated value of the actual torque from the measured value of the actual torque.

8. The method according to claim 1, which comprises determining the estimated value of the actual torque as a function of an ignition-angle efficiency value, an air/fuel ratio efficiency value, and a reference value of the torque, the reference value of the torque depending on the air mass flow rate into the cylinder and on a rotational speed.

9. The method according to claim 8, which comprises additionally determining the estimated value of the actual torque as a function of a cylinder shut-off efficiency value.

10. The method according to claim 1, which comprises determining the air mass flow rate by an observer as a function of a measured air mass flow rate.

11. The method according to claim 1, wherein the determining an actuator signal step is performed by determining an actuator signal for a throttle valve of the internal combustion engine.

* * * * *